US006118078A

United States Patent [19]

Schulz

[11] Patent Number: 6,118,078

[45] Date of Patent: Sep. 12, 2000

[54] STRUCTURAL ELEMENT

[75] Inventor: Daniel Schulz, Kilchberg, Switzerland

[73] Assignee: Micafil AG, Zurich, Switzerland

[21] Appl. No.: 09/141,587

[22] Filed: Aug. 28, 1998

[30] Foreign Application Priority Data

Aug. 30, 1997 [DE] Germany ..... 197 37 995

[51] Int. Cl.[7] ..... H01B 17/00

[52] U.S. Cl. ..... 174/139; 174/140 S; 174/163 R; 174/158 R

[58] Field of Search ..... 174/30, 139, 140 S, 174/163 R, 158 R, 209

[56] References Cited

U.S. PATENT DOCUMENTS

| | | | |
|---|---|---|---|
| 4,421,948 | 12/1983 | Willem | 174/158 R |
| 4,963,428 | 10/1990 | Harvey et al. | 428/220 |
| 5,163,714 | 11/1992 | Issenmann | 285/54 |
| 5,428,100 | 6/1995 | Asai et al. | 524/496 |
| 5,791,911 | 8/1998 | Fasano et al. | 439/63 |
| 5,904,984 | 5/1999 | Smith et al. | 428/396 |

*Primary Examiner*—Kristine Kincaid
*Assistant Examiner*—W. David Walkenhorst
*Attorney, Agent, or Firm*—Burns, Doane, Swecker & Mathis, L.L.P.

[57] ABSTRACT

The structural element (1) for transferring mechanical forces between subassemblies at different electric potentials has an electrically insulating body which is provided with a mount (4) at each of it ends. The electrically insulating body at least partially contains LCP material. The mounts (4) are connected non-positively and positively to the electrically insulating body. Thanks to the use of LCP material, the structural element (1) can be made with particularly low mass, at low cost and with high mechanical strength.

6 Claims, 2 Drawing Sheets

STRUCTURAL ELEMENT

BACKGROUND OF THE INVENTION

1. Field of the Invention

The invention relates to a structural element for transferring mechanical forces between subassemblies at different electrical potentials.

2. Discussion of Background

In switch technology, electrically insulating structural elements are used, for example, for transferring mechanical forces between subassemblies at different electric potentials. If they are subjected to high mechanical loading, these structural elements are produced from fiber reinforced plastics. Usually, epoxy resins are used as the plastics, and, for example, glass fibers, polyester fibers and the like are used for the reinforcement. In the manufacture of the structural elements according to one of the known methods, the fibers are impregnated with the corresponding plastics under positive pressure or under normal pressure or under negative pressure, and then, after corresponding shaping, are subsequently cured. The blanks produced in this way are mechanically finished, and if this does not already take place with the shaping, provided at both ends with fittings, which are provided for the introduction of the mechanical forces into the insulating bodies of the structural element. These known production methods provide structural elements which meet all the operational requirements, but are comparatively expensive and complex to manufacture. If comparatively long-filament reinforcing fibers are used, special attention must be paid to the formation of the transitional region between the fiber and the polymer matrix surrounding it, since otherwise the dielectric strength of the structural element is not ensured.

U.S. Pat. No. 4,963,428 discloses that liquid crystal polymers (LCP) can be manufactured in film form by means of a special extrusion process.

SUMMARY OF THE INVENTION

Accordingly, one object of the invention, is to provide a novel electrically insulating structural element which is suitable for transferring mechanical forces and can be produced with particularly low mass, at low cost and with high mechanical strength.

The use of LCP (Liquid Crystal Polymers) for structural elements subjected to high mechanical and dielectric loading makes it possible to manufacture these structural elements with lower mass but the same strength. In switch technology in particular, such structural elements can be used advantageously. However, it is also conceivable that such structural elements can be used in electrical machine construction or in transformer construction. LCP is a thermoplastic polyester material which can be used advantageously in the temperature range prevailing in circuit breakers. In the material LCP, the molecules are arranged in a specifically oriented manner. If it is ensured in the manufacture of structural elements that the LCP molecules are oriented in the direction of principal mechanical loading, a significantly greater mechanical strength of the structural elements produced from LCP is achieved, with the same dimensions as structural elements produced conventionally, for example from a reinforced polyester composite material.

Without adversely affecting this molecular alignment too much, the material LCP may be processed together with conventional mineral fillers, such as for example silica flour, aluminium oxide $Al_2O_3$, wollastonite, glass beads, chopped glass strands, synthetic mineral fibers, etc. Particularly suitable as fillers are fibers of a length from 10 $\mu$m to 1000 $\mu$m and a slenderness ratio in the range from 1:5 to 1:50.

If the structural element has to meet high dielectric and high mechanical requirements, chopped wollastonite fibers are preferably used as the filler. The fiber length of these chopped wollastonite fibers lies in the range specified above. About 15 to 45 per cent by volume of chopped wollastonite fibers are admixed.

These structural elements, designed for high dielectric and mechanical loads, may be used both in switchgear technology and in outdoor switchgear as well as in metal-enclosed switchgear with single-phase or multi-phase segregation, in particular for transferring driving forces to the moving parts of circuit breakers or disconnectors. It is also conceivable, however, to use such structural elements for terminations subjected only to static loading or as insulators which fix the high-tension conductors in switchgear or in transformers. Many other application possibilities are conceivable, in particular also in areas where no dielectric stresses occur.

Exemplary embodiments of the invention and the advantages which can be accomplished therewith are explained in more detail below with reference to the drawing, which merely represents one possible way of implementing it.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
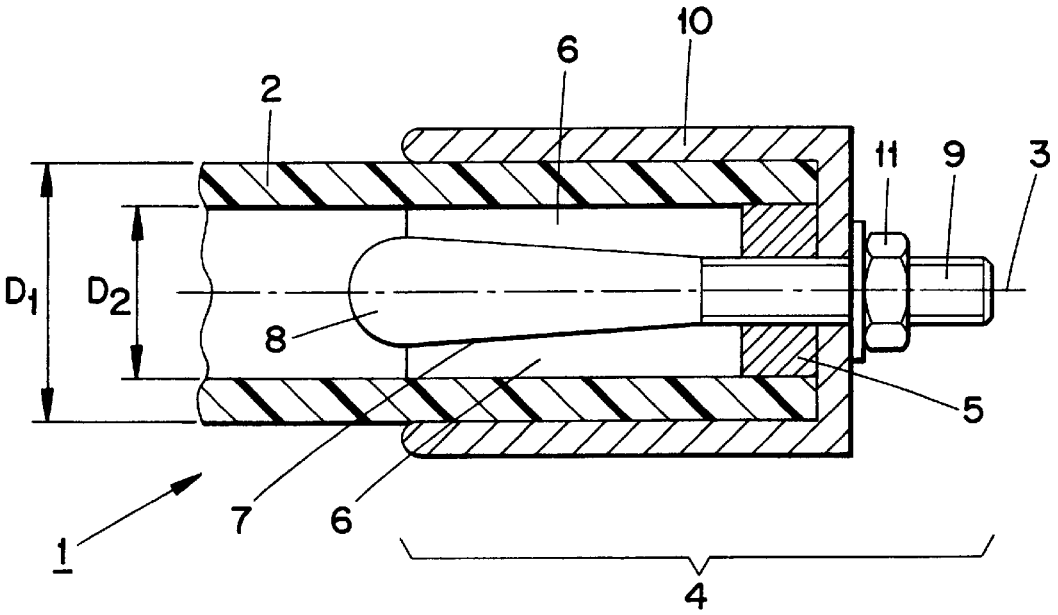
FIG. 1 shows a diagrammatically represented partial section through a first embodiment of a structural element according to the invention.

Referring now to the drawings, wherein like reference numerals designate identical or corresponding parts throughout the several views and all elements not required for a direct understanding of the invention are not represented, in FIG. 1 there is shown a diagrammatically represented partial section through a first embodiment of a structural element 1 according to the invention. This structural element 1 is designed as an electrically insulating pull rod, which, for example, mechanically actuates a circuit-breaker arcing chamber at high voltage potential. This structural element 1 has an insulating tube 2, which is manufactured from a liquid crystal polymer, referred to as LCP, by means of a known extrusion process, using a fixed or a rotating extrusion head. The cylindrically designed insulating tube 2 has an outside diameter $D_1$ and an inside diameter $D_2$; its length is determined by the potential to be bridged by means of the structural element 1. The insulating tube 2 extends along a center axis 3.

At the two ends of the insulating tube 2 there is provided in each case a multi-part mount 4, which is rigidly connected to the insulating tube 2 and on the one hand grasps the ends of the insulating tube 2 and on the other hand permits the connection of the insulating tube 2 to the moving parts of the drive or of the arcing chamber of the circuit breaker. This mount 4 has a metallic sleeve 5, which is pushed into the insulating tube 2 and is provided with at least one axially extended slot 6. In the region of the slot 6, the sleeve 5 has a conically designed central bore 7, which opens toward the respectively opposite end of the insulating tube 2. Recessed into this bore 7 is a metallic expander 8, which has a correspondingly designed surface, fitting the conical bore 7. The end of the expander 8 facing the respectively opposite end of the insulating tube 2 is of a dielectrically favorable design.

Formed onto the expander 8 is a threaded bolt 9, which extends through the bottom of the sleeve 5 and through a metallic supporting sleeve 10. The side of the supporting sleeve 10 facing the respectively opposite end of the insulating tube 2 is of a dielectrically favorable design. The supporting sleeve 10 externally encloses the end of the insulating tube 2, the insulating tube 2 and the sleeve 5 resting flush on the bottom of the supporting sleeve 10. The expander 8 is braced against the bottom of the supporting sleeve 10 by means of a nut 11, screwed onto the threaded bolt 9. The expander 8 expands the sleeve 5 in the slotted region, and said sleeve then presses the insulating tube 2 against the inside wall of the supporting sleeve 10, so that this end of the insulating tube 2 is securely clamped. The metallic mount 4, which comprises the expander 8, the threaded bolt 9, the nut 11 and the supporting sleeve 10, is then fixed immovably on the insulating tube 2. The nut 11 is generally tightened with a predetermined torque. This clamping location is designed to be approximately twice as long as the outside diameter $D_1$ of the insulating tube 2. The protruding end of the threaded bolt 9 can be used for the connection of the structural element 1 to further subassemblies.

Figure 2:
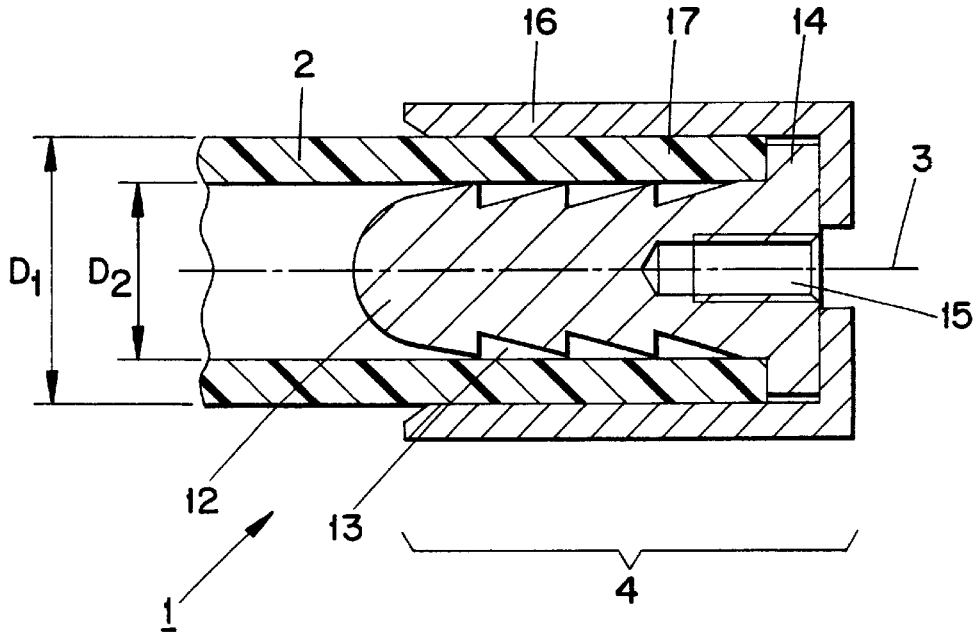
FIG. 2 shows a diagrammatically represented partial section through a second embodiment of a structural element according to the invention.

FIG. 2 shows a partial section through a second embodiment of a structural element 1 according to the invention. In the case of this embodiment, a metallic inner fitting 12 is pressed into the heated insulating tube 2. The inner fitting 12 is of a dielectrically favorable design on the side facing the respectively opposite end of the insulating tube 2. The surface of the inner fitting 12 facing the inner surface of the insulating tube 2 is provided with peripheral grooves 13, which have sawtooth-like tips or rounded-off flanks, which dig into the inner surface of the insulating tube 2 to some extent when the LCP material cools, thereby producing a good connection which is secured against slipping. The inner fitting 12 has a collar 14, which serves as a stop for the end of the insulating tube 2. The inner fitting 12 is provided with a centrally arranged threaded bore 15, which can be used for the connection of the structural element 1 to further subassemblies.

The connection which is secured against slipping is further improved by means of an outer sleeve 16 shrunk-on in the warm state. The outer sleeve 16 has a bottom with a central opening. The outer sleeve 16 is pushed onto the insulating tube 2, connected to the inner fitting 12, until it is touching the bottom of the collar 14. The outer sleeve 16 is produced from metal; its inner bore 17 has an undersize of about 0.2 mm, so that, when the outer sleeve 16 is shrunk onto the insulating tube 2 in the warm state, a press fit is produced, whereby the insulating sleeve 2 is additionally pressed against the inner fitting 12. In this way, a particularly secure and durable connection is achieved between the mount 4, comprising the inner fitting 12 and the outer sleeve 16, and the insulating tube 2. This connection location is designed to be about twice as long as the outside diameter $D_1$ of the insulating tube 2.

Figure 3:
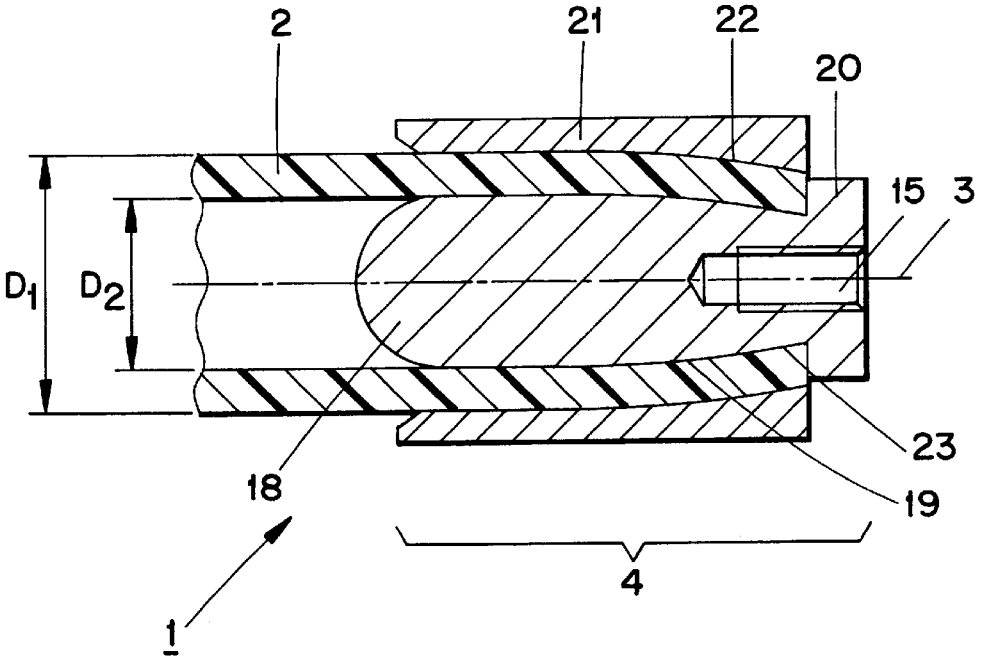
FIG. 3 shows a diagrammatically represented partial section through a third embodiment of a structural element according to the invention.

FIG. 3 shows a partial section through a third embodiment of a structural element 1 according to the invention. In the case of this embodiment, a metallic inner fitting 18 is pushed into the heated insulating tube 2. The inner fitting 18 is of a dielectrically favorable design on the side facing the respectively opposite end of the insulating tube 2. That surface of the inner fitting 18 facing the inner surface of the insulating tube 2 is largely of a cylindrical design, this cylindrical part merging in the direction of the respective end of the insulating tube into a region 19 of a spherical design. This region 19 is formed onto the cylindrically designed part with a radius of about 1000 mm, without an edge. This region 19 is adjoined by a collar 20, which serves as a stop for the end of the insulating tube 2 which has been pushed onto the inner fitting 18. The inner fitting 18 is provided with a centrally arranged threaded bore 15, which can be used for the connection of the structural element 1 to further subassemblies.

The connection between the inner fitting 18 and the insulating tube 2 is established by means of an outer sleeve 21 shrunk-on in the warm state. The end of the outer sleeve 21 facing the respectively opposite end of the insulating tube 2 is of a dielectrically favorable design. This outer sleeve 21 is produced from metal; its inner bore 22 is adapted to the outer shape of the inner fitting 18; it has an undersize of about 0.2 mm, so that, when the outer sleeve 21 is shrunk onto the insulating tube 2 in the warm state, a press fit is produced, whereby the insulating tube 2 is pressed against the inner fitting 18. By this shrinking on, the end of the insulating tube 2 is pressed into the recess 23 in the spherical region 19 on the outer side of the inner fitting 18. In the end region, the insulating tube 2 is thereby upset in such a way that the wall thickness increases to some extent there, whereby the insulating tube 2 is secured against axial slipping. In this way, a particularly secure and durable connection is achieved between the mount 4, comprising the inner fitting 18 and the outer sleeve 21, and the insulating tube 2. This connection location is designed to be about twice as long as the outside diameter $D_1$ of the insulating tube 2.

Figure 4:
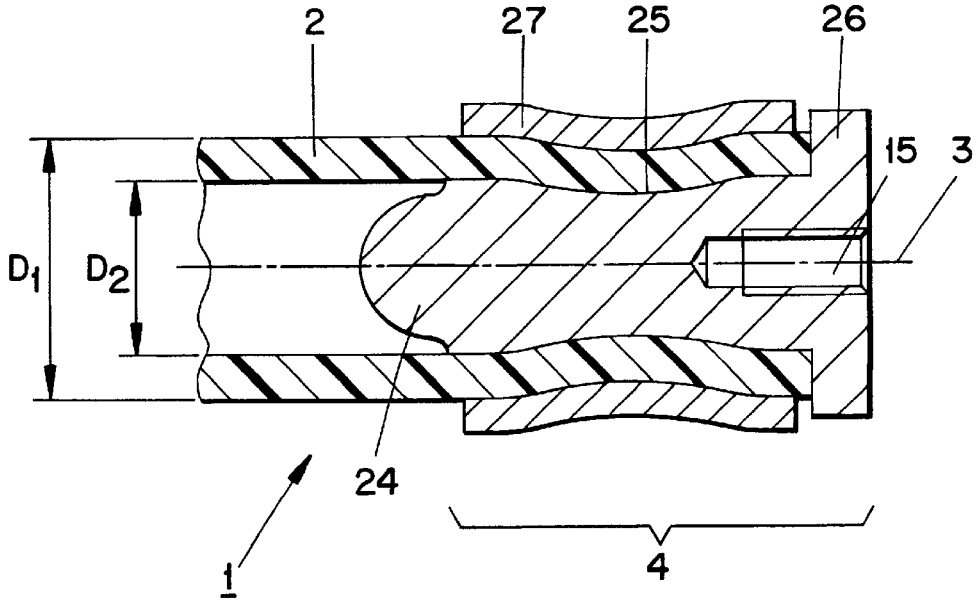
FIG. 4 shows a diagrammatically represented partial section through a fourth embodiment of a structural element according to the invention.

FIG. 4 shows a diagrammatically represented partial section through a fourth embodiment of a structural element 1 according to the invention. In the case of this embodiment, a metallic inner fitting 24 is pushed into the heated insulating tube 2. The inner fitting 24 is of a dielectrically favorable design on the side facing the respectively opposite end of the insulating tube 2. That surface of the inner fitting 24 facing the inner surface of the insulating tube 2 is of a cylindrical design at both ends. Provided between the two cylindrically designed regions is a hollow 25, which is about 3 mm deep, has a radius of about 100 mm and merges in a well rounded-off manner into the cylindrical regions mentioned. The cylindrically designed end region is adjoined by a collar 26, which serves as a stop for the end of the insulating tube 2 which has been pushed onto the inner fitting 24. The connection between the inner fitting 24 and the insulating tube 2 is established by means of a metallic pressing sleeve 27, which is initially of a cylindrical design and is pushed onto the respective end of the insulating tube 2 in the warm state and is then pressed together in the direction of the center axis 3 by means of a corresponding pressing tool. The pressing sleeve 27 thereby presses the insulating tube 2 into the hollow 25 in a positively engaging manner, so that the insulating tube 2 is optimally secured against axial slipping. The end of the pressing sleeve 27 facing the respectively opposite end of the insulating tube 2 is of a dielectrically favorable design. In this way, a particularly secure and durable connection is achieved between the mount 4, comprising the inner fitting 24 and the pressing sleeve 27, and the insulating tube 2. This connection location is designed to be about twice as long as the outside diameter $D_1$ of the insulating tube 2.

If the hollow 25 represented in FIG. 4 is made slightly less deep, it is possible also to connect the insulating tube 2 to the mount 4 in the cold state. Furthermore, it is possible to connect the mount 4 to the insulating tube 2 by means of an adhesive bond. It is also conceivable to connect the mount 4 to the insulating tube 2 by means of a shrinking operation, which is combined with an adhesive bond, in order to obtain a particularly secure connection.

Used as the material for the manufacture of the insulating tube 2 for the exemplary embodiments described was the material Vectra A 540, which was processed by an extrusion process which uses a rotating extrusion head. The name Vectra is a registered trademark of the company Hoechst Aktiengesellschaft, D-65926 Frankfurt am Main. Contained in this material are 40% of a chopped-fiber wollastonite. If heating takes place before connecting to the mount 4, the insulating tube 2 is in each case heated to 250° C.

In the case of the embodiments described, it proves to be advisable to produce the metal parts of the respective mount 4 from an aluminum alloy, since in this way the mass of the structural element 1 can be kept advantageously small. Use of the high-strength LCP material likewise permits advantageous reduction of the mass of the structural elements 1. Particularly in the case of structural elements 1 which are used for transferring driving forces to moving parts of circuit breakers or disconnectors, this reduction of the masses to be moved is of advantage, since both the drive and the necessary damping elements for the damping of the driving movements when running into an end position can be manufactured in smaller sizes and consequently at lower cost.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A structural element for transferring mechanical forces between subassemblies at different electric potentials, comprising:

an electrically insulating body including two ends and a mount at each of the two ends;

the electrically insulating body at least partially contains LCP material;

the mounts are connected to the electrically insulating body;

the electrically insulating body comprises an insulating tube having and extending along a center axis; and the insulating tube comprising axially oriented LCP molecules.

2. The structural element as claimed in claim 1, wherein the mounts are connected to the insulating tube with adhesive.

3. The structural element as claimed in claim 1, wherein the insulating tube is produced from an LCP material with which wollastonite has been admixed.

4. The structural element as claimed in claim 3, wherein the wollastonite is in the form of fibers, and 15 to 45 percent by volume of wollastonite is admixed.

5. The structural element as claimed in claim 4, wherein 40 percent by volume of wollastonite is admixed.

6. The structural element as claimed in claim 1, wherein the insulating tube has an outside diameter and the mounts extend along said insulating tube a distance about twice as long as the outside diameter of the insulating tube.

* * * * *